US008919642B2

(12) United States Patent
Seibert

(10) Patent No.: US 8,919,642 B2
(45) Date of Patent: Dec. 30, 2014

(54) DEVICE FOR HANDLING VALUE NOTES

(75) Inventor: Joachim Seibert, Brilon (DE)

(73) Assignee: Wincor Nixdorf International GmbH (DE)

( * ) Notice: Subject to any disclaimer, the term of this patent is extended or adjusted under 35 U.S.C. 154(b) by 23 days.

(21) Appl. No.: 13/498,132

(22) PCT Filed: Aug. 27, 2010

(86) PCT No.: PCT/EP2010/062528
§ 371 (c)(1),
(2), (4) Date: Mar. 30, 2012

(87) PCT Pub. No.: WO2011/036023
PCT Pub. Date: Mar. 31, 2011

(65) Prior Publication Data

US 2012/0216726 A1 Aug. 30, 2012

(30) Foreign Application Priority Data

Sep. 25, 2009 (DE) ..... 10 2009 043 090

(51) Int. Cl.
*G07F 19/00* (2006.01)
*G07D 11/00* (2006.01)

(52) U.S. Cl.
CPC ..... *G07D 11/0078* (2013.01); *G07F 19/20* (2013.01)
USPC ..... 235/379; 235/375

(58) Field of Classification Search
USPC ..... 235/375, 379
See application file for complete search history.

(56) References Cited

U.S. PATENT DOCUMENTS 5,563,393 A * 10/1996 Coutts ..... 235/379
6,104,928 A * 8/2000 Waugh ..... 455/445
6,324,402 B1 * 11/2001 Waugh et al. ..... 455/445
6,836,670 B2 * 12/2004 Castrogiovanni et al. .... 455/558

(Continued)

FOREIGN PATENT DOCUMENTS

DE 19932149 A1 1/2001
DE 20001117 U1 6/2001

(Continued)

OTHER PUBLICATIONS

International Search Report (in English) and Written Opinion of the International Searching Authority (in German) for PCT/EP2010/062528, mailed Jan. 24, 2011; ISA/EP.

(Continued)

*Primary Examiner* — Paultep Savusdiphol
(74) *Attorney, Agent, or Firm* — Harness, Dickey & Pierce, P.L.C.

(57) ABSTRACT

The invention relates to a device (10, 50, 60) for handling notes of value, which comprises a control unit (38) which executes program data of a computer program. Further, the device (10, 50, 60) has an authentication data memory (28) in which authentication data for the unambiguous authentication of the device (10, 50, 60) are stored. The control unit (38) generates an unambiguous reference value dependent on the authentication data. Further, the device (10, 50, 60) comprises a transmission unit (20, 64) which transmits reference data comprising the reference value for generating a device-individual license key to a license management unit (46). Further, the transmission unit (20, 46) receives data comprising the license key from the license management unit (46). The control unit (38) enables at least one function module of the computer program dependent on the license key.

20 Claims, 3 Drawing Sheets

(56) References Cited

U.S. PATENT DOCUMENTS

| | | | | |
|---|---|---|---|---|
| 7,395,766 | B2 | 7/2008 | Landwehr et al. | |
| 7,433,848 | B1 | 10/2008 | Albrecht et al. | |
| 7,435,119 | B2 * | 10/2008 | Chang et al. | 439/188 |
| 7,437,181 | B2 * | 10/2008 | Simmons | 455/558 |
| 8,086,855 | B2 * | 12/2011 | Katz et al. | 713/170 |
| 2003/0179884 | A1 * | 9/2003 | Guterman | 380/46 |
| 2004/0043792 | A1 * | 3/2004 | Simmons | 455/558 |
| 2004/0046015 | A1 * | 3/2004 | Skinner | 235/379 |
| 2005/0102230 | A1 * | 5/2005 | Haidar | 705/40 |
| 2006/0291455 | A1 * | 12/2006 | Katz et al. | 370/355 |
| 2008/0061127 | A1 * | 3/2008 | Brexel | 235/379 |
| 2008/0102680 | A1 * | 5/2008 | Chang et al. | 439/326 |
| 2009/0108059 | A1 * | 4/2009 | Aas et al. | 235/379 |
| 2009/0235363 | A1 * | 9/2009 | Tomita | 726/27 |
| 2009/0265276 | A1 | 10/2009 | Jordan | |
| 2010/0117844 | A1 | 5/2010 | Brexel et al. | |
| 2010/0146264 | A1 | 6/2010 | Blume et al. | |
| 2010/0213023 | A1 | 8/2010 | Freitag et al. | |
| 2010/0310069 | A1 | 12/2010 | Krummel et al. | |
| 2011/0056415 | A1 | 3/2011 | Moog et al. | |
| 2011/0101013 | A1 | 5/2011 | Berendes | |
| 2011/0181416 | A1 | 7/2011 | Dietz et al. | |
| 2012/0032391 | A1 | 2/2012 | Holland-Letz et al. | |

FOREIGN PATENT DOCUMENTS

| | | | |
|---|---|---|---|
| DE | 102004006509 | A1 | 12/2005 |
| DE | 10 2004 061 467 | A1 | 6/2006 |
| EP | 0712099 | A1 | 5/1996 |
| EP | 1564610 | A2 | 8/2005 |
| WO | WO-01/54084 | A1 | 7/2001 |
| WO | WO-02/075670 | A1 | 9/2002 |

OTHER PUBLICATIONS

International Preliminary Report on Patentability (Chapter I of the Patent Cooperation Treaty) in English for PCT/EP2010/062528, issued Apr. 3, 2012.

* cited by examiner

DEVICE FOR HANDLING VALUE NOTES

CROSS-REFERENCE TO RELATED APPLICATIONS

This application is a National Stage of International Application No. PCT/EP2010/062528, filed Aug. 27, 2010, and published in German as WO/2011/036023 on Mar. 31, 2011. This application claims the benefit and priority of German Application No. 10 2009 043 090.3, filed Sep. 25, 2009. The entire disclosures of the above applications are incorporated herein by reference.

BACKGROUND

This section provides background information related to the present disclosure which is not necessarily prior art.

1. Technical Field

The invention relates to a device for handling notes of value. The device comprises a control unit for controlling the device, the control unit executing program data of a computer program.

2. Discussion

The device is in particular an automated teller machine, an automatic cash register system or an automatic cash safe. The control unit of the automated teller machine, the automatic cash register system or, respectively, the automatic cash safe executes program data of a computer program which in particular serves to control the operating sequences of the automated teller machine, the automatic cash safe or, respectively, the automatic cash register system. The company which sells the computer program is, as in the case of computer programs for PCs, interested in licensing the computer program to the operator of the automated teller machine, the automatic cash register system or, respectively, the automatic cash safe to thus prevent the unlicensed use and/or the illegal copying of the computer program.

The automated teller machines, automatic cash register systems and/or automatic cash safes are usually integrated into a computer network of the operator via which the operator can in particular monitor the status of the automated teller machine, the automatic cash register system or, respectively, the automatic cash safe and the stock of notes of value in the cash cassettes accommodated therein. One possibility of carrying out the licensing of the computer program is that the licensor, i.e. the company that has programmed the computer program and/or sells the computer program is granted access to this computer network. This has the disadvantage that via the computer networks of the operator, in particular in the case of banks, access to confidential data which the service provider must not access is possible. One possibility of preventing this is the use of complex data protection system, such as firewall systems. This, however, incurs high costs and an additional expense for the operator. Moreover, the licensing via the Internet is problematic for security reasons.

Another possibility of licensing is that the licensing already takes place at the manufacturer of the automated teller machine in that the manufacturer asks the operator of the device for the required data. The manufacturer of the automated teller machine, the automatic cash register system or, respectively, the automatic cash safe in this case only installs those function modules of the computer program on the automated teller machine, the automatic cash system or, respectively, the automatic cash safe that have been purchased by the operator of the device. This has the disadvantage that, on the one hand, this method means additional expenses for the manufacturer. On the other hand, it is disadvantageous that on each automated teller machine, automatic cash register system or, respectively, on each automated cash safe, different program data of the computer program have to be installed. This, too, incurs additional expenses and additional costs.

SUMMARY OF THE INVENTION

It is an object of the invention to specify a device for handling notes of value which enables an easy, safe licensing of a computer program to be executed by a control unit of the device.

By providing an authentication data memory in which authentication data for the unambiguous authentication of the device are stored and by providing a transmission unit via which reference data that comprise a reference value generated dependent on the authentication data are transmitted to a license management unit, it is achieved that the device can be unambiguously identified and authenticated by the license management unit. Here, the identification in particular takes place via a device-individual serial number. For authentication, in addition to the serial number, further data, in particular a PIN and/or a password, preferably a one-time password, are transmitted to the license management unit. By authenticating the device, compared to a mere identification of the device, manipulation attempts by which the licensing is to be evaded are prevented. In particular, this prevents the transmission of a serial number arbitrarily made up by the operator of the device. Further, by way of the authentication, transmission errors are faster noticed than in the case of a mere identification since in the case of transmission errors the serial number transmitted for the identification does, for example, not correspond to the associated password.

By means of the authentication data memory with the authentication data stored therein the device has a feature for the unambiguous identification and authentication of the device. By the presence of the feature for the authentication in the form of data it is achieved that the feature used for the unambiguous identification or, respectively, authentication can be easily transmitted to a licensor without it first having to be converted into a data structure. Further, such data can be further processed by the license management unit easily. Further, such as in the case of a serial number firmly engraved in the device, this serial number does not have to be read out manually on site and be transmitted to the license management unit. This saves expenses and time.

By enabling at least one function module of the computer program by the control unit dependent on data comprising a license key, which data were generated by the license management unit dependent on the transmitted reference data, it is achieved that at first the entire computer program can be installed on several similar devices, and the function modules booked by the licensee are individually enabled via the licensing. The computer program is in particular factory-preinstalled. Alternatively, the computer program can also be installed with all function modules at the first start-up of the device. Since at first the entire program is installed and later on, based on the licensing, the booked function modules are individually enabled, the expense for the manufacturer of the device is reduced. The reference data preferably comprise in addition to the reference value also information on the operator of the device. Further, the reference data can additionally or alternatively comprise order information.

The device in particular comprises a subscriber identity module (SIM) with a memory area in which the authentication data are stored. The SIM in particular comprises the authentication data memory. The SIM can in particular be used for further functions of the device, in particular for a remote maintenance via mobile radio and/or a stock management of the stock of notes of values in the cash cassettes accommodated in the device via mobile radio. By storing the authentication data in the SIM, an additional separate memory element can be dispensed with. In particular, for the authentication of the device at the license management unit the same authentication data are used as are used for the authentication during remote maintenance or, respectively, during stock management. Alternatively, for the various functions also different authentication data can be used.

Further, the SIM comprises, by default, authentication data which are needed to authenticate the SIM at a mobile radio service provider. These authentication data can also be used for the authentication of the device at the license management unit so that no further authentication data are required. Alternatively, for authentication at the license management unit also other authentication data can be used.

It is advantageous when a telephone number is unambiguously assigned to the device by means of the SIM. This telephone number can in particular be used for identifying the device by the license management unit and is in particular a part of the reference data transmitted to the license management unit.

In a memory area of the SIM, application data for encrypting and/or signing data to be transmitted to the license management unit and/or for decrypting and/or verifying the signature of data received from the license management unit can be stored. By encrypting and/or signing the data, the transmission security is increased and the use and/or manipulation of the transmitted data by unauthorized people is prevented or at least made more difficult. Further, these application data can also be used for generating the reference data, as a result whereof program data of an algorithm that determines the reference value from the authentication data can be dispensed with. Alternatively, the control unit can execute program data of an algorithm for generating the reference value.

Further, it is advantageous when the transmission unit comprises at least one interface via which the reference data can be transmitted to an exchangeable removable medium and via which the data with the license key can be read in from an exchangeable removable medium. The interface in particular comprises an USB interface, a CD drive, a DVD drive and/or a disk drive. As an exchangeable medium a USB stick, a CD, a DVD and/or a disk are used accordingly. In this embodiment of the invention, the reference data transmitted via the interface to the exchangeable removable medium are transmitted manually from the device to the license management unit by means of the removable medium. By the license management unit, the data comprising the license key are generated and stored on a further or the same removable medium. This removable medium is in turn brought to the device. The data comprising the license key are transmitted to the device via the interface. In this way, an easy type of licensing is achieved in which no data have to be transmitted over a network so that a highest possible data security is achieved. In this embodiment of the invention, the SIM merely serves as an unambiguous feature for the authentication and the identification of the device, but is not used for the transmission of the reference data via mobile radio.

In a particularly preferred embodiment of the invention, the transmission unit comprises a radio unit for sending and receiving data via mobile radio. The radio unit sends the reference data via mobile radio to the license management unit and receives the data comprising the license key from the license management unit. In this way, a particularly easy licensing method is realized. Since the data are transmitted via mobile radio, the reference data do not have to be fetched manually from the device and the data comprising the license key do not have to be manually installed on the device. This saves costs and time. Further, in this way, the data can be transmitted between the device and the license management unit without the license management unit having to have access to a computer network of the operator of the device. In this way, the data security of the data which can be accessed via the computer network of the operator is increased. Further, the operator does not have to take any data security measures specifically for preventing unauthorized access to these data by the license management unit. By transmitting the data via mobile radio, a secure direct transmission of the data between the license management unit and the device takes place.

It is particularly advantageous when the transmission unit comprises both a radio unit and an interface for transmitting the reference data to an exchangeable removable medium and for reading in data from an exchangeable removable medium. In this way, the licensing can also be carried out when no mobile radio is possible since then the licensing can be carried out via the interface.

As the SIM is required anyway for the transmission of the data between the device and the license management unit via mobile radio, it is in this case particularly advantageous to store the authentication data on the SIM since in this way an additional memory element can be saved. This simplifies the structure of the device and costs are saved.

The radio unit sends the reference data to the license management unit in particular when the device is put into operation for the first time. In this way, it is achieved, on the one hand, that the licensing is carried out before the device starts its designated standard operation. On the other hand, it is achieved in this way that the function modules of the computer program purchased by the operator of the device are enabled as quickly as possible. By transmitting the data via mobile radio a fast data transmission is achieved.

The device is preferably connected to a computer network of the operator of the device via a cable-based and/or cable-free network connection, by which the operator of the device can monitor the status of the device, for example the stock of notes of value in the cash cassettes accommodated in the device and/or actual values of parameters. The data transmission via the radio unit between the device and the license management unit takes place separately and independently of this network connection. Thus, a complete separation from the computer network of the operator is achieved so that the license management unit does not have to fall back on the computer network of the operator for licensing the computer program to be executed by the control unit of the device. In this way, the data security of the operator is increased and the acceptance of the licensing at the operators of automated teller machines, automatic cash register systems and/or automatic cash safes is increased.

The radio unit transmits the reference data preferably automatically to the license management unit when the device is put into operation for the first time. In this way, it is achieved that the licensing cannot be evaded as it automatically takes place upon start-up.

Additionally or alternatively, the radio unit can also transmit the reference data to the license management unit when it has first received inquiry data from the license management unit. In this way, it is achieved that the sending of the reference data can take place at a point in time fixed by the license management unit. In particular, it is achieved in this way that, if required, the reference data can be transmitted several times and at any time.

In a preferred embodiment of the invention, the radio unit only sends data to the license management unit when the radio unit has first received authentication data for the unambiguous authentication of the license management unit from the license management unit. In this way, it is guaranteed that the reference data are exclusively transmitted to an authorized license management unit and cannot be queried by arbitrary mobile radio subscribers. In this way, the required data security is achieved. In a particularly preferred embodiment of the invention, the authentication data via which the radio unit authenticates the license management unit comprise a telephone number of the license management unit. In addition to the telephone number, in particular a PIN and/or a password are transmitted, via which the authentication takes place. Alternatively, in the radio unit a list of telephone numbers of the license management unit can be stored and the radio unit can only accept calls from these telephone numbers. Further, for authentication of the license management unit also the authentication data can be used which are required by the license management unit to log in and to authenticate itself at the mobile radio service provider. For this, the license management unit preferably likewise comprises a SIM.

It is advantageous when the device comprises a subscriber identity module (SIM) with a memory area in which the authentication data are stored, via which a telephone number is unambiguously assigned to the device, and when the license management unit calls this telephone number for transmitting the data comprising the license key and/or for transmitting the inquiry data. In this way, it is guaranteed that the data are transmitted from the license management unit to the designated device. Thus, errors in licensing are prevented, and in particular it is prevented that the wrong function modules of the computer program are enabled.

In a preferred embodiment of the invention, the device interrupts the mobile radio connection established between the device and the license management unit by calling the telephone number of the device by the license management unit after the radio unit has received the inquiry data. Thereafter, the device calls the license management unit back for transmitting the reference data. In this way, the security of the data transmission is increased since it is achieved that via the call back the device only transmits the data to that license management unit whose telephone number is stored for example in a memory area of the SIM of the device.

The radio unit in particular comprises a mobile phone for sending and receiving the data. In this way, a simple and cost-efficient structure of the radio unit is achieved.

Further, it is advantageous when the radio unit of the device receives update data with updates for the computer program from the license management unit via mobile radio. In this way, the computer program can be updated quickly in an easy manner. In particular, for updating the computer program no employee of the license management unit has to transmit the update data on site to the device and install them thereat. The update data comprise in particular so-called hotfixes and/or security patches.

The license management unit is preferably integrated into a license management center of the manufacturer or distributor of the computer program that is remote from the device. The license management unit is in particular a part of a data processing system of the computer program manufacturer.

In a preferred embodiment of the invention, the device comprises a maintenance data memory in which maintenance data are stored. The radio unit transmits the authentication data and the maintenance data to a service unit via mobile radio. The maintenance data in particular comprise information on malfunctions of the device, information from fault storages, logging files, desired values of presettable parameters and/or current actual values of presettable parameters. By transmitting the maintenance data by means of the mobile radio unit, a remote maintenance of the device by the service unit is made possible. Since the transmission of the maintenance data by the radio unit takes place independently of the computer network of the operator of the device into which the device is integrated, the service unit has no access to the computer network of the operator so that the operator does not have to protect its computer network against unauthorized accesses of the service provider by means of complex systems, such as firewall systems. Thus, a simple and cost-efficient remote maintenance is made possible. The service unit is in particular integrated into a service center of a service provider in charge of the maintenance of the device.

Further, it is advantageous when the device comprises a safe for accommodating cash cassettes, in which at least one cash cassette comprising an authentication data memory is accommodated. In the authentication data memory, authentication data for the unambiguous authentication of the cash cassette by a service unit are stored. The radio unit of the device transmits the authentication data stored in the authentication data memory of the cash cassette and stock data with information on the current stock of notes of value in the cash cassette to the service unit via mobile radio. In this way, an easy stock management of the cash cassette accommodated in the device via mobile radio is made possible. The stock data can thus be transmitted to the service unit without the service unit having to have access to the computer network of the operator of the device. By transmitting the stock data of the cash cassette to the service unit via mobile radio it is guaranteed that the service provider can empty or, respectively, fill the cash cassette before the cash cassette is completely filled or, respectively, completely emptied. By providing the authentication data memory with the authentication data stored therein it is guaranteed that the cash cassette can be unambiguously identified and authenticated by the service unit so that the necessary security is guaranteed. The service unit is in particular arranged in a service center of a service provider in charge of the filling and emptying of the cash cassettes of the device that is arranged remote from the device. The service unit provided for the stock management, the license management unit provided for licensing and the service unit provided for the remote maintenance can be different units or the same unit.

In a particularly preferred embodiment of the invention, the cash cassette likewise comprises a SIM with a memory area for storing the stock data and/or the authentication data. The stock data comprise the current stock of notes of value in the cash cassette, preferably information on the serial number, the currency, the denomination and/or the order of all notes of value contained in the cash cassette. In this way, a closed money circuit, a so-called cash cycle management of the second order, is made possible in which the cash cassettes are exchanged between automated teller machines, automatic cash register systems and/or automatic cash safes without these first having to be emptied and newly filled in a cash center that serves as a headquarter. Thus, expenses and time are saved.

In a further embodiment of the invention, the device comprises a safe for accommodating cash cassettes in which at least one cash cassette is accommodated which comprises a memory element and a radio unit for sending data from the cash cassette to a service unit via mobile radio and/or for receiving data from the service unit. In the memory element of the cash cassette, authentication data for the unambiguous authentication of the cash cassette by the service unit are stored. The radio unit of the cash cassette transmits the authentication data stored in the authentication data memory of the cash cassette and stock data with information on the current stock of notes of value in the cash cassette via mobile radio to the service unit. In this way, the current stock of the service unit can be transmitted from the cash cassette to the service unit at any time, even if the cash cassette is not accommodated in an automated teller machine, an automatic cash register system and/or an automatic cash safe.

The data transmission between the service unit for the maintenance and the device and/or the data transmission between the service unit for the stock management and the device or, respectively, the cash cassette can take place in the same manner as previously described for the data transmission between the device and the license management unit. In particular, the authentication data memory of the cash cassette can be developed in the same manner as the authentication data memory of the device. The data transmission between the service unit for the maintenance and the device and/or the data transmission between the service unit for the stock management and the device or, respectively, the cash cassette can be developed in particular with the features specified in the subclaims.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
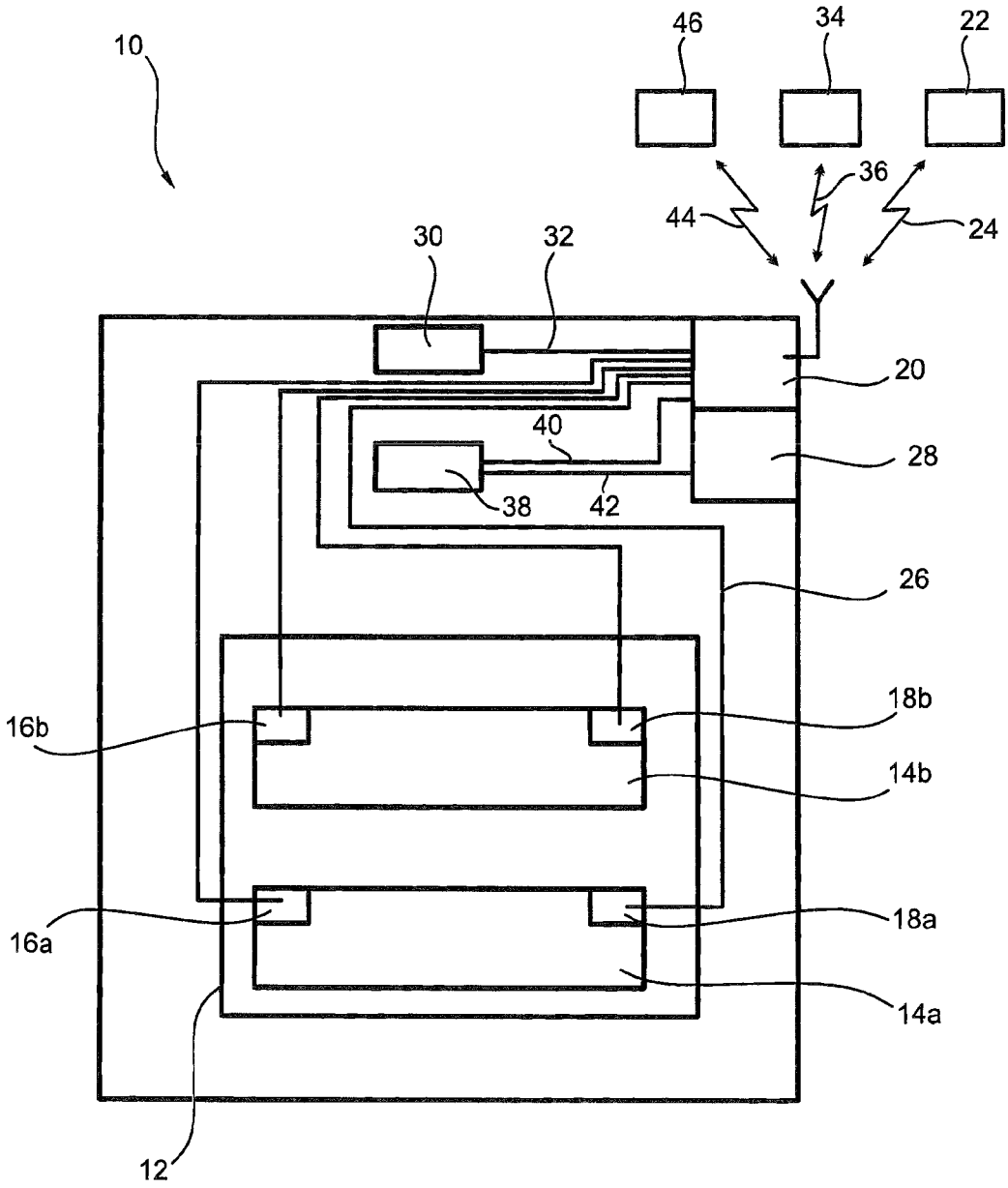
FIG. 1 shows a schematic illustration of a device for handling notes of value according to a first embodiment of the invention.

In FIG. 1, a schematic illustration of a device 10 for handling notes of value according to a first embodiment of the invention is shown. In this embodiment, the device 10 is an automated teller machine. Alternatively, the device 10 can also be an automatic cash register system or an automatic cash safe.

The automated teller machine 10 comprises a safe 12 in which two cash cassettes 14*a*, 14*b* are accommodated. By means of the safe 12, the cash cassettes 14*a*, 14*b* are protected against unauthorized access. In an alternative embodiment, the automated teller machine 10 can also only comprise one cash cassette 14*a*, 14*b* or more than two cash cassettes 14*a*, 14*b*. The cash cassettes 14*a*, 14*b* are connected via a non-illustrated transport path to a likewise not illustrated input and output module for depositing and/or withdrawing notes of value.

The two cash cassettes 14*a*, 14*b* each comprise a stock data memory 16*a*, 16*b* and a subscriber identity module (SIM) 18*a*, 18*b*. In each stock data memory 16*a*, 16*b*, stock data with information on the current stock of notes of value in the respective cash cassette 14*a*, 14*b* are stored. Preferably, the serial number, the order, the denomination or the currency of all notes of value held in the respective cash cassette 14*a*, 14*b* are stored in the stock data memory 16*a*, 16*b*, as a result whereof a closed money circuit, a so-called cash cycle management of the second order, is made possible because the current stock of the cash cassettes 14*a*, 14*b* is known at any time. In this way, the cash cassettes 14*a*, 14*b* can be exchanged between different automated teller machines 10 without a revision having to be carried out first.

Further, the automatic teller machine 10 comprises a radio unit 20 for sending data to a stock service unit 22 and for receiving data from this stock service unit 22 via mobile radio. The receiving and sending of data via mobile radio is indicated by the double arrow 24. The SIMs 18*a*, 18*b* of the cash cassettes 14*a*, 14*b* each comprise a memory area in which authentication data for the unambiguous authentication of the cash cassettes 14*a*, 14*b* by the stock service unit 22 are stored. Via these authentication data, the individual cash cassettes 14*a*, 14*b* can be unambiguously identified and authenticated by the stock service unit 22. Both the SIMs 18*a*, 18*b* of the cash cassettes 14*a*, 14*b* and the stock data memories 16*a*, 16*b* are connected to the radio unit 20. The SIMs 18*a*, 18*b* and the stock data memories 16*a*, 16*b* are preferably connected to the radio unit 20 via data cables for data transmission. One of these data cables is exemplarily identified with the reference sign 26. Alternatively, the SIMs 18*a*, 18*b* and/or the stock data memories 16*a*, 16*b* can also be connected to the radio unit 20 via a cable-free data connection.

The radio unit 20 sends stock data with information on the current stock of notes of value in the cash cassettes 14*a*, 14*b* and the authentication data stored in the SIMs 18*a*, 18*b* via mobile radio 24 to the stock service unit 22. In this way, the stock service unit can monitor the stock of notes of value in the cash cassettes 14*a*, 14*b* at any time. When the stock in a cash cassette 14*a*, 14*b* exceeds an upper limit value or when the stock in a cash cassette 14*a*, 14*b* falls below a lower limit value, then the stock service unit 22 causes that the respective cash cassette 14*a*, 14*b* is filled with notes of value or, respectively, emptied. In this way, it is guaranteed that the cash cassettes 14*a*, 14*b* are emptied or, respectively, filled in time so that there will be no downtimes of the automated teller machine 10 and a customer using the automated teller machine 10 is paid out a desired amount of money at any time and/or can deposit a desired amount of money at any time.

The stock service unit 22 is in particular integrated into a service center, preferably a data processing system, of a service company in charge of the stock management of the automated teller machine 10. The service company is in particular a valuable transport company which is in charge of a plurality of automated teller machines 10, automatic cash register systems and/or automatic cash safes and which distributes notes of value to be paid out from these or, respectively, notes of value deposited therein, in particular in the form of a closed money circuit, between the individual automated teller machines 10, the automatic cash register systems and/or the automatic cash safes and a cash center. The stock service unit 22 is in particular arranged remotely from the automated teller machine 10.

The points in time at which the stocks in the cash cassettes 14*a*, 14*b* are transmitted to the stock service unit 22 via mobile radio 24 can be fixed in different ways.

In a first embodiment, the stock data of the individual cash cassettes 14*a*, 14*b* can be transmitted to the stock service unit 22 at preset periodically recurring time intervals. Here, the SIMs 18*a*, 18*b* of the cash cassettes 14*a*, 14*b* are connected to the radio unit 20 in accordance with these time intervals so that within this time interval the stock data of the cash cassette 14*a*, 14*b* connected to the radio unit 20 can be transmitted to the stock service unit 22.

In a second embodiment, the device 10 can comprise a non-illustrated control unit which compares the current stock of notes of value in the cash cassettes 14*a*, 14*b* with the upper and the lower limit value. When the current stock in a cash cassette 14*a*, 14*b* exceeds the upper limit value or when the current stock of a cash cassette 14*a*, 14*b* falls below the lower limit value then the stock data are sent to the stock service unit 22 via the radio unit 20. Alternatively, also each cash cassette 14*a*, 14*b* can comprise a control unit which compares the current stock with the upper and the lower limit value. The upper and the lower limit value can be differently preset for each cash cassette 14*a*, 14*b*.

In a further embodiment, the stock data can be transmitted to the stock service unit 22 when the stock service unit 22 has first transmitted inquiry data to the radio unit 20 of the automated teller machine 10. For this, the SIMs 18*a*, 18*b* of the cash cassettes 14*a*, 14*b* can be alternately connected to the radio unit 20 at periodically recurring time intervals. Only within the time interval within which the respective SIM 18*a*, 18*b* is connected with the radio unit 20, the stock service unit 22 can query the stock data of the respective cash cassette 14*a*, 14*b*.

For inquiry of the stock data, the stock service unit 22 can in particular call a telephone number that is unambiguously assigned to the respective cash cassette 14*a*, 14*b* via the respective SIM 18*a*, 18*b*. Alternatively, the automated teller machine 10 can also comprise a SIM 28 via which a telephone number is unambiguously assigned to the automated teller machine 10. For each telephone number of the cash cassettes 14*a*, 14*b*, a call forwarding to the telephone number of the automated teller machine 10 is set up, preferably automatically, so that the inquiry data which were sent to a telephone number of a cash cassette 14*a*, 14*b* are forwarded to the telephone number of the automated teller machine 10 and can be received by the automated teller machine 10 at any time. The radio unit 20 then transmits the stock data of the respective cash cassette 14*a*, 14*b* to the stock service unit 22.

Alternatively, the afore-described embodiments for fixing the points in time at which the stock data are transmitted can also be combined with one another. In particular, the stock data can be transmitted at fixed points in time and can in addition be queried between the points in time by the stock service unit 22 if required.

The radio unit 20 only transmits data to the stock service unit 22 when it has first received authentication data for the unambiguous authentication of the stock service unit 22 by the stock service unit 22. In this way, it is guaranteed that the data can only be transmitted to an authorized stock service unit 22 and cannot be queried by any mobile radio subscriber.

Prior to their transmission, the data transmitted from the radio unit 20 to the stock service unit 22 are encrypted and/or signed by means of application data for encrypting and/or signing data that are stored on the SIM 28 of the automated teller machine 10 or the respective SIM 18*a*, 18*b* of the respective cash cassette 14*a*, 14*b*. In this way, a secure transmission is achieved so that the data cannot be used and/or manipulated by unauthorized mobile radio subscribers.

By authenticating the cash cassette 14*a*, 14*b* at the stock service unit 22 and by authenticating the stock service unit 22 at the automated teller machine 10, a two-way-authentication is achieved, as a result whereof it is guaranteed that the data are only transmitted between authorized units.

The stock data and the authentication data are transmitted successively, the authentication data being transmitted first and then the stock data being transmitted. Alternatively, the authentication data and the stock data can also be transmitted jointly. As authentication data in particular those authentication data can be used which are used on the SIM 18*a*, 18*b*, 28 for the authentication of the SIM 18*a*, 18*b*, 28 at the mobile radio service provider. Thus, no further authentication data for the authentication of the cash cassettes 14*a*, 14*b* or, respectively, of the automated teller machine 10 at the stock service unit 22 have to be stored on the SIM 18*a*, 18*b*, 28.

Further, the automated teller machine 10 comprises a maintenance memory 30 which is connected to the radio unit 20 via a data cable 32. In the maintenance data memory 30 maintenance data are stored. The maintenance data can in particular comprise information about malfunctions of the automated teller machine 10, data of fault storages, logging files, desired values of parameters of the automated teller machine 10 and/or actual values of parameters of the automated teller machine 10.

The SIM 28 of the automated teller machine 10 comprises a memory area in which authentication data for the unambiguous authentication of the automated teller machine 10 at a maintenance service unit 34 are stored. The radio unit 20 transmits the authentication data stored on the SIM 28 of the automated teller machine 10 and the maintenance data to the maintenance service unit 34 via mobile radio 36. The authentication of the automated teller machine 10 at the maintenance service unit 34 can take place in the same manner as previously described for the authentication of the cash cassettes 14*a*, 14*b* at the stock service unit 22. By transmitting the maintenance data via mobile radio 36 a remote maintenance of the automated teller machine 20 is made possible in an easy manner. The radio unit 20 transmits the maintenance data to the maintenance service unit 34 at preset time intervals, for example daily at midnight.

In an alternative embodiment, the maintenance data can also be transmitted to the maintenance service unit 34 when at least one piece of information contained in the maintenance data has changed, in particular when there is a malfunction of the automated teller machine 10. In this way, it is achieved that the maintenance service unit 34 is informed about the presence of a malfunction immediately after the occurrence of a malfunction so that the malfunction can be removed as soon as possible. For removal of the malfunction, the maintenance service unit 34 sends via mobile radio 36 data with at least one setting value to be preset and/or at least one instruction to be executed, via which the present malfunction is to be removed. Alternatively, the radio connection can also only be established unidirectionally between the radio unit 20 and the maintenance service unit 34, i.e. the radio unit 20 can indeed send data to the maintenance service unit 34 but cannot receive any data from the maintenance service unit 34. In this case, malfunctions have to be removed on site by an employee of the maintenance service company. The maintenance service unit 34 is in particular integrated into a data processing system of a maintenance service company. The maintenance service unit 34 and the stock service unit 22 can be identical or can be separate units.

The data transmitted between the radio unit 20 and the maintenance unit 34 are, as already previously described for the data transmitted between the radio unit 20 and the stock service unit 22, encrypted and/or signed. The radio unit 20 preferably only transmits data to the maintenance service unit 34 and/or only sets the transmitted setting values or, respectively, only executes the received instructions when it has first received authentication data for the unambiguous authentication of the maintenance service unit 34 from the maintenance service unit 34.

Further, the automated teller machine 10 comprises a control unit 38 which is connected to the radio unit 20 and the SIM 28 of the automated teller machine 10 via data cables 40, 42. The control unit 38 executes program data of a computer program for the control of the automated teller machine 10. For the licensing of this computer program or of modules of the computer program the control unit 38 reads out the authentication data which are stored in the SIM 28 and generates a reference value dependent on these authentication data. The radio unit 20 then sends via mobile radio 44 reference data which comprise the reference value to a license management unit 46. The license management unit 46 generates dependent on the reference data and the function modules booked by the licensee, in particular the operator of the automated teller machine 10, a license key and sends data comprising the license key via mobile radio 44 to the radio unit 20. The control unit 38 then enables the function modules of the computer program purchased by the licensee dependent on the license key. The reference data in particular comprise the reference value, information about the licensee and/or order information.

The license management unit is in particular integrated into a data processing system of the licensor. The licensor is in particular the manufacturer of the computer program whose program data are executed by the control unit 38.

In this way, an easy licensing method for licensing the computer program is achieved. In particular, the licensing of the computer program can take place without data having to be manually installed on the automated teller machine 10. The computer program with all its function modules is in particular factory-preinstalled on the automated teller machine 10 or is completely installed upon start-up of the automated teller machine 10. The modules purchased by the licensee are then enabled by the licensing. On each automated teller machine 10, the same computer program or, dependent on which function modules have been purchased by the operator of the automated teller machine 10, a different computer program can be factory-preinstalled. This reduces the expenses. The reference data are in particular transmitted from the automated teller machine 10 to the license management unit 46 when the automated teller machine 10 is put into operation for the first time.

The data transmission between the automated teller machine 10 and the license management unit 46 only takes place when the license management unit 46 has authenticated itself at the automated teller machine 10 by sending authentication data and/or when the automated teller machine 10 has authenticated itself at the license management unit 46 by sending the authentication data stored on the SIM 28. As already described, the data transmitted between the license management unit 46 and the automated teller machine 10 are encrypted and/or signed. For this, likewise application data preferably stored in a memory area of the SIM 28 are used.

The automated teller machine 10 is in particular integrated into a computer network of the operator, into which several automated teller machines, automatic cash register systems and/or automatic cash safes are integrated and via which the operator can retrieve and/or manage current information about the automated teller machines, automatic cash register systems and/or automated cash safes at any time. By transmitting the stock data, the maintenance data and the reference data via mobile radio 24, 36, 44 to the stock service unit 22, the maintenance service unit 34 or, respectively, the license management unit 46 it is achieved that the stock service unit 22, the maintenance service unit 34 and the license management unit 46 do not require access to this computer network. In this way, the data security within the computer network of the operator is increased because there is no access from outside. In particular, in this way, cost-efficient and complex firewalls can be dispensed with. On the other hand, the service units 22, 34 and the license management unit 46 need not be configured on different network structures at different operators of automated teller machines, automatic cash register systems and/or automatic cash safes.

In an alternative embodiment of the invention, the authentication data need not be stored in the respective SIM 18*a*, 18*b*, 28 but can stored in separate authentication data memories. Further, alternatively, the stock service unit 22 and the maintenance service unit 34 can be the same service unit, in particular when the service company in charge of the stock management and the service company in charge of the maintenance are the same service company.

The maintenance of the automated teller machine 10 is in particular carried out by the manufacturer of the automated teller machine 10. The license management unit 46 is in particular integrated into a service center of the manufacturer of the computer program whose program data are executed by the control unit 38. In this case, updates of the computer program can be transmitted from the license management unit 46 via mobile radio 44 to the radio unit 20. In this way, it is achieved that the updates do not have to be installed on the automated teller machine 10 manually on site, but can be transmitted and installed cost-efficiently, quickly and easily via mobile radio 44. The updates in particular comprise so-called hotfixes and/or security patches.

In an alternative embodiment of the invention, also only the stock management and the licensing of the automated teller machine 10 can be carried out via mobile radio. Likewise, alternatively, also only the maintenance and the licensing can be carried out via mobile radio.

Figure 2:
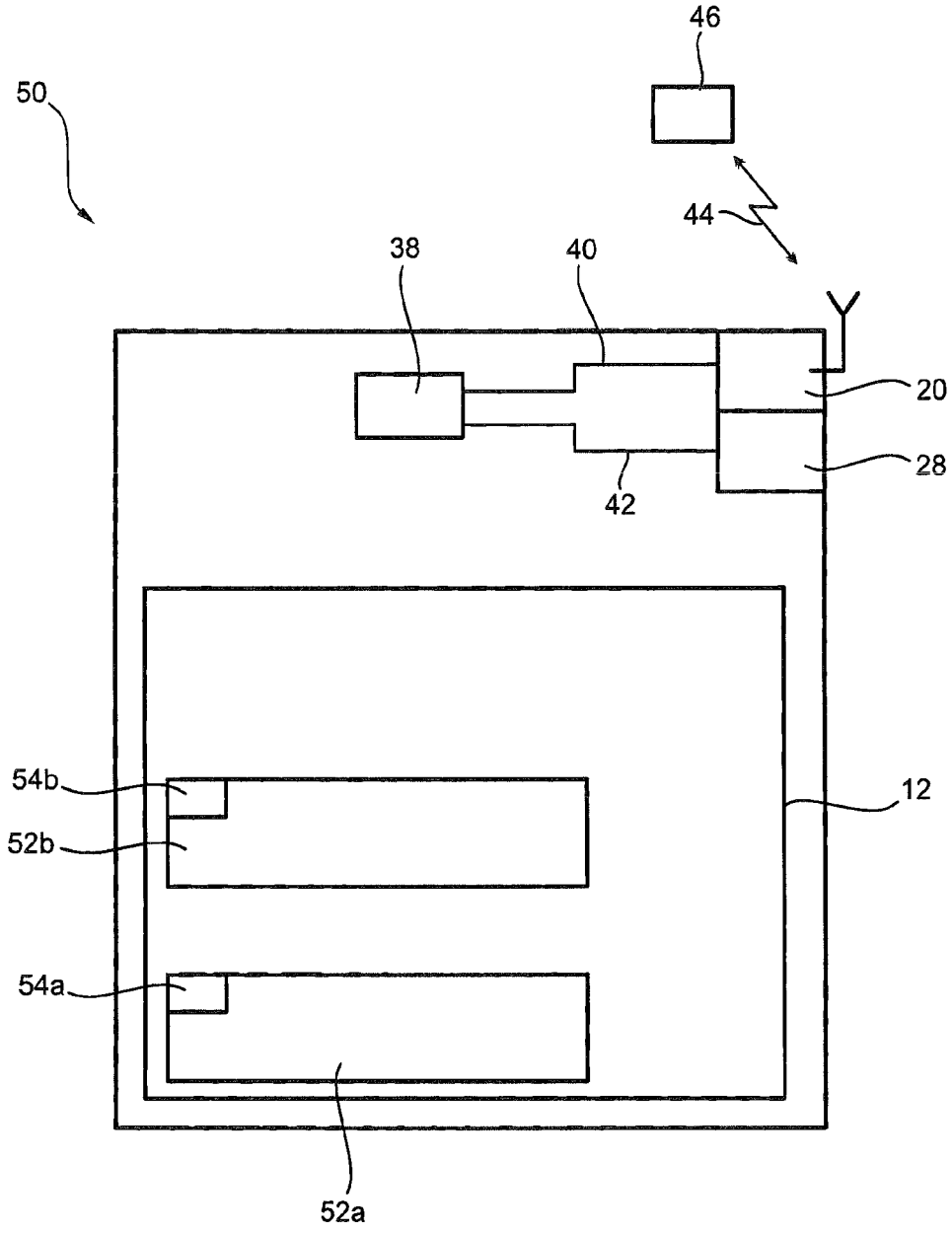
FIG. 2 shows a schematic illustration of a device for handling notes of value according to a second embodiment of the invention.

In FIG. 2, a schematic illustration of a device 50 for handling notes of value according to a second embodiment of the invention is shown. Elements having the same structure or the same function are identified with the same reference signs.

In contrast to the automated teller machine 10 shown in FIG. 1, in the device 50 according to FIG. 2, the radio unit 20 exclusively serves to transmit data between the device 50 and the license management unit 46 via mobile radio 44. A remote maintenance via mobile radio takes place just as little as a stock management. The cash cassettes 52*a*, 52*b* accommodated in the safe 12 of the device 50 each only have a stock data memory 54*a*, 54*b* but no SIM. The filling and emptying of the cash cassettes 52*a*, 52*b* either takes place at fixed points in time and/or when the operator of the device 50, as a result of the current filling level of one of the cassettes 52*a*, 52*b*, instructs the service company in charge of the filling and emptying of the cash cassettes 52*a*, 52*b* to do so.

In a further alternative embodiment of the invention, in addition to the licensing also the remote maintenance can take place via mobile radio. In a further alternative embodiment, in addition to the licensing via mobile radio 44 also the stock management can be carried out via mobile radio.

Figure 3:
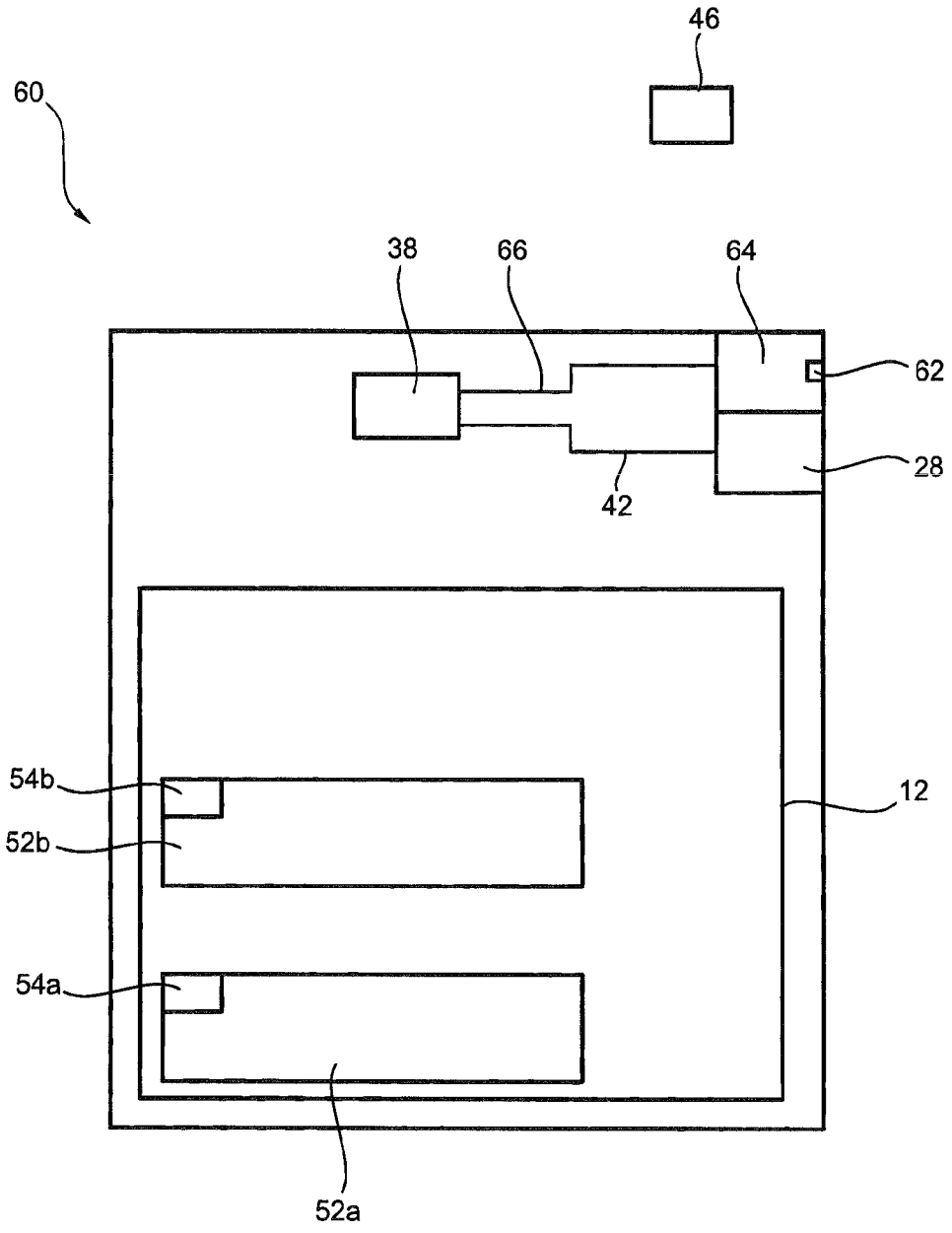
FIG. 3 shows a schematic illustration of a device for handling notes of value according to a third embodiment of the invention.

In FIG. 3, a schematic illustration of a device 60 for handling notes of value according to a third embodiment of the invention is shown. In this embodiment of the invention, the device 60 comprises no radio unit but instead a transmission unit 64 having an interface 62. The interface 62 is in particular an interface that is complementary to a removable medium, such as a USB interface, a CD drive, a DVD drive and/or a disk drive to which an exchangeable removable medium, in particular a USB stick, a CD, a DVD, and/or a disk can be connected. The transmission unit 64 is connected to the control unit 38 via the data cable 66.

In this embodiment, the reference data are stored on the exchangeable removable medium connected to the device 60 via the interface 62. Thereafter, the removable medium with the reference data stored thereon is manually transported to the license management unit 46 by which the reference data stored on the removable medium are read out. Further, the data comprising the license key are generated by the license management unit 46 and are stored on the same or another removable medium. The removable medium with the data comprising the license key is manually transported to the device. The exchangeable removable medium is connected to the interface 62 and the data comprising the license key are transmitted via the interface 62. Thereafter, the control unit 38 enables the purchased function modules of the computer program dependent on the transmitted data.

By transmitting the data between the device 60 and the license management unit 46 via an exchangeable removable medium a high data security is achieved since the confidential data are not transmitted via a mobile radio network or other networks. Further, in this way, a licensing can also take place when no mobile radio network is available for transmitting data via mobile radio 44. In this embodiment, the SIM 28 merely serves as an unambiguous feature for identifying and authenticating the device 60 as well as a memory element for the authentication data. In this embodiment, it is not required for the dial-up into a mobile radio network.

In a further alternative embodiment of the invention, the device 60 can comprise both an interface 62 and a radio unit 20. In this embodiment, the data are transmitted between the license management unit 46 and the device 60 preferably via mobile radio 44 and are transmitted via the interface 62 by means of an exchangeable removable medium only when no mobile radio network is available.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for handling notes of value, comprising a control unit for controlling the device, and an authentication data memory in which authentication data for the unambiguous authentication of the device are stored, wherein the control unit executes program data of a computer program, the control unit reads out the authentication data and generates an unambiguous reference value dependent on the authentication data, a transmission unit transmits reference data for generating a device-individual license key to a license management unit, the reference data including the reference value and at least one of license information or order information, the reference data comprise the reference value, the transmission unit receives data comprising the license key from the license management unit, and wherein the control unit enables at least one function module of the computer program dependent on the license key.

2. The device according to claim 1, the device comprises a subscriber identity module (SIM) with a memory area for storing the authentication data.

3. The device according to claim 2, a telephone number is unambiguously assigned to the device by means of the SIM.

4. The device according to claim 2, wherein application data for encrypting and/or signing data to be transmitted and/or for decrypting and/or verifying the signature of received data are stored on the SIM.

5. The device according to claim 1, wherein the computer program is factory-preinstalled.

6. The device according to claim 1, wherein the control unit executes an algorithm by means of program data for generating the reference value.

7. The device according to claim 1, wherein the transmission unit comprises at least one interface via which the reference data can be transmitted to an exchangeable removable medium and via which the data with the license key can be read in from an exchangeable removable medium.

8. The device according to claim 1, wherein the transmission unit comprises a radio unit for sending and receiving data via mobile radio, in that the radio unit sends the reference data via mobile radio to the license management unit and in that the radio unit receives the data comprising the license key from the license management unit via mobile radio.

9. The device according to claim 8, the radio unit automatically sends the reference data to the license management unit when the device is put into operation for the first time.

10. The device according to claim 8, wherein the device is integrated into a computer network of an operator of the device via a cable-based and/or a cable-free network connection, and in that the data transmission via mobile radio by means of the radio unit takes place separately and independently of the network connection.

11. The device according to claim 8, wherein the radio unit only sends data to the license management unit when it has received authentication data for the unambiguous authentication of the license management unit from the license management unit.

12. The device according to claim 8, wherein the radio unit receives data with updates for the computer program sent from the license management unit via mobile radio.

13. The device according to claim 8, wherein the device comprises a maintenance data memory in which maintenance data are stored, and in that the radio unit transmits the authentication data and the maintenance data to a service unit via mobile radio.

14. The device according to claim 8, wherein the device comprises a safe for accommodating cash cassettes, in that in the safe at least one cash cassette comprising an authentication data memory is accommodated, in that in the authentication data memory authentication data for the unambiguous authentication of the cash cassette by a service unit are stored, in that stock data with information on the current stock of notes of value in the cash cassette can be determined, and in that the radio unit transmits the authentication data stored in the authentication data memory of the cash cassette and the stock data to the service unit via mobile radio.

15. The device according to claim 8, wherein the device comprises a safe for accommodating cash cassettes, in that in the safe at least one cash cassette is accommodated which comprises a memory element and a radio unit for sending data from the cash cassette to a service unit via mobile radio and/or for receiving data sent from the service unit via mobile radio, in that in the memory element of the cash cassette authentication data for the unambiguous authentication of the cash cassette by the service unit are stored, in that stock data with information on the current stock of notes of value in the cash cassette can be determined, and in that the radio unit of the cash cassette transmits the authentication data stored in the memory element of the cash cassette and the stock data to the service unit via mobile radio.

16. A device for handling notes of value, the device comprising:

an authentication data memory unit in which authentication data for the unambiguous authentication of the device is stored;

a control unit configured to execute program data of a computer program, read the authentication data, and generate an unambiguous reference value dependent on the authentication data, the reference value is included with reference data for generating a device-individual license key to a license management system, the reference data including the reference value and at least one of license information or order information; and a transmission unit configured to transmit the reference data, and receive data including the device-individual license key from the license management unit;

wherein the control unit is configured to enable at least one function module of the computer program dependent on the license key.

17. The device of claim 16, the device further comprising a subscriber identity module (SIM) with a memory module for storing the authentication data.

18. The device of claim 16, wherein the transmission unit includes a radio unit configured to send the reference data by radio to the license management unit, and receive the license key from the license management unit.

19. The device of claim 18, wherein the radio unit transmits data to the license management unit only when the radio unit has received the authentication data for the unambiguous authentication of the license management unit from the license management unit.

20. The device of claim 18, wherein the device includes a safe configured to accommodate cash cassettes therein, at least one of the cash cassettes includes an authentication data memory in which is stored authentication data for the unambiguous authentication of the cash cassette by a service unit; and wherein the radio unit transmits the authentication data stored in the authentication data memory of the cash cassette and the stock data to the service unit by radio.

* * * * *